United States Patent [19]

Newton

[11] Patent Number: 4,762,237

[45] Date of Patent: Aug. 9, 1988

[54] STORAGE SYSTEM

[75] Inventor: Brian L. Newton, Woonsocket, R.I.

[73] Assignee: Dart Industries Inc., Deerfield, Ill.

[21] Appl. No.: 846,684

[22] Filed: Apr. 1, 1986

[51] Int. Cl.[4] ..... A47F 5/08

[52] U.S. Cl. ..... 211/115; 211/131; 248/342; 248/221.4

[58] Field of Search ..... 108/149, 94, 143; 312/246, 248, 245, 252; 248/221.4, 224.4, 225.1, 318, 342, 343, 317; 62/382, 381; 211/115, 113, 78, 131

[56] References Cited

U.S. PATENT DOCUMENTS

| | | | |
|---|---|---|---|
| 271,054 | 1/1883 | Fowler . | |
| 1,315,922 | 9/1919 | Franklin | 108/143 |
| 1,684,558 | 9/1928 | Schwarz | 62/382 X |
| 1,687,581 | 10/1928 | Murphy | 211/113 |
| 1,754,094 | 4/1930 | Glass, Sr. . | |
| 1,774,312 | 8/1930 | Braeutigam | 62/382 |
| 1,859,352 | 5/1932 | Albee . | |
| 1,961,502 | 6/1934 | Marengo | 108/94 |
| 1,977,092 | 10/1934 | Scurlock . | |
| 2,005,939 | 6/1935 | Hibbard, Jr. | 211/113 X |
| 2,018,002 | 10/1935 | Avery | 62/382 X |
| 2,030,899 | 2/1936 | Scurlock . | |
| 2,058,002 | 10/1936 | Daum . | |
| 2,062,807 | 12/1936 | Cramer . | |
| 2,089,359 | 8/1937 | Goulooze | 312/246 X |
| 2,110,921 | 3/1938 | Scurlock . | |
| 2,431,837 | 10/1947 | Spotts et al. | 211/77 |
| 2,451,110 | 10/1948 | Newman . | |
| 2,553,880 | 5/1951 | Stigler . | |
| 2,557,801 | 6/1951 | Shapiro . | |
| 2,614,703 | 10/1952 | Molins et al. | 108/149 |
| 2,754,166 | 7/1956 | Ohm | 211/78 X |
| 2,978,285 | 4/1961 | Jester . | |
| 3,169,496 | 2/1965 | Muggli et al. | 108/94 |
| 3,302,594 | 2/1967 | Barnett et al. . | |
| 3,385,465 | 5/1968 | Bliss . | |
| 3,397,805 | 8/1968 | Berend . | |
| 3,503,523 | 3/1970 | Hamilton et al. . | |
| 3,789,800 | 2/1974 | Steudler, Jr. | 248/221.4 X |
| 3,851,357 | 12/1974 | Ribich et al. | 248/221.4 X |
| 3,877,580 | 4/1975 | Hammar . | |
| 4,227,343 | 10/1980 | Espy et al. | 248/318 X |
| 4,424,904 | 1/1984 | Applegate, Jr. | 108/94 X |
| 4,441,583 | 4/1984 | Vaught | 211/113 X |
| 4,544,119 | 10/1985 | Kellett et al. | 248/221.4 X |
| 4,597,616 | 7/1986 | Trubrano | 312/246 |

FOREIGN PATENT DOCUMENTS

| | | | |
|---|---|---|---|
| 2133673 | 8/1984 | United Kingdom | 248/318 |

*Primary Examiner*—Kenneth J. Dorner
*Assistant Examiner*—José V. Chen
*Attorney, Agent, or Firm*—John A. Doninger

[57] ABSTRACT

A storage system including a mounting bracket comprising a horizontal base with a pair of laterally spaced upwardly directed mounting arms integral with the base and resiliently inwardly flexible relative to each other, each mounting arm terminating in spaced relation above the base in a laterally outwardly directed mounting flange for engagement with an overhead structure. A pair of oppositely directed L-shaped supports are integrally formed with the base and depend therebelow for engagement with an enlarged head on the upper end of a tray assembly handle. The tray assembly includes a base axially receiving the lower end of the handle for support therefrom, and a rotatable platform surrounding the handle and bearing-supported on the tray base for rotation relative thereto.

24 Claims, 3 Drawing Sheets

FIG. 1
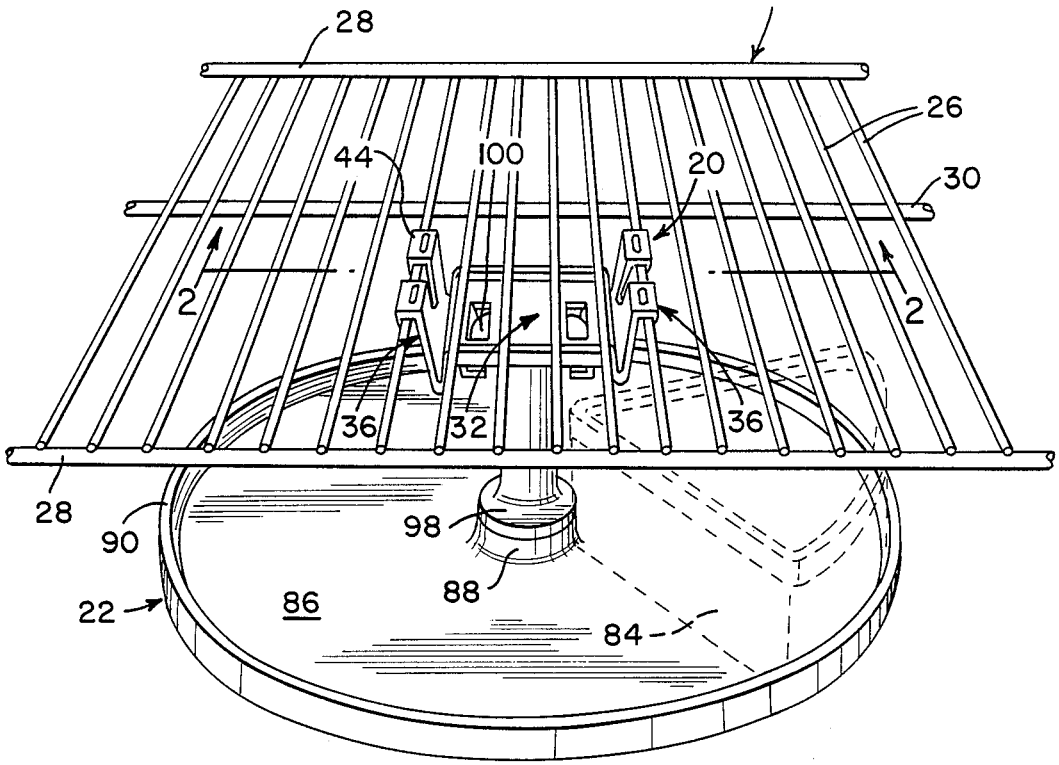
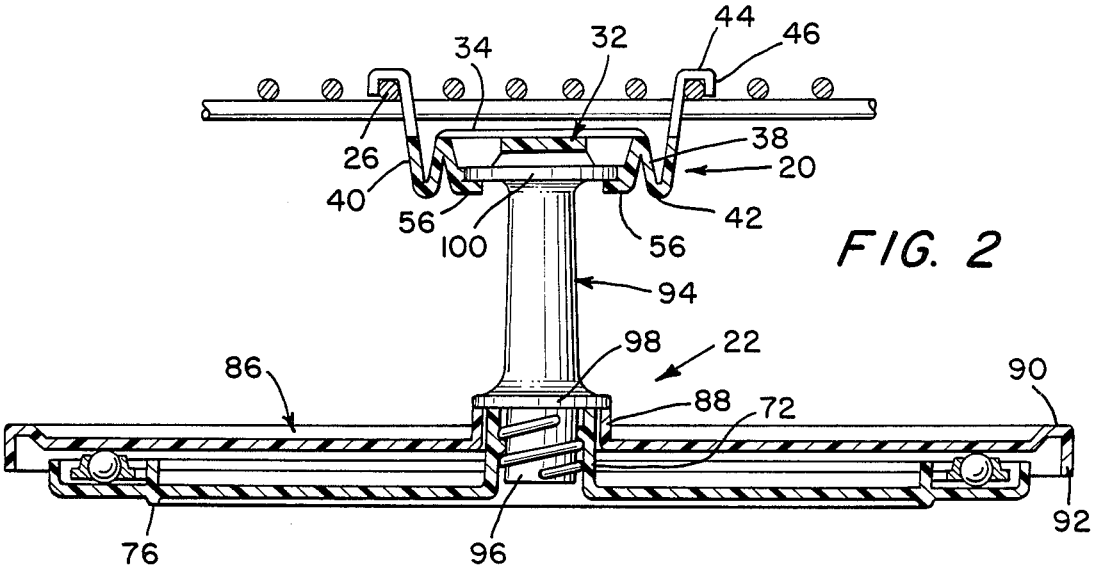
FIG. 2
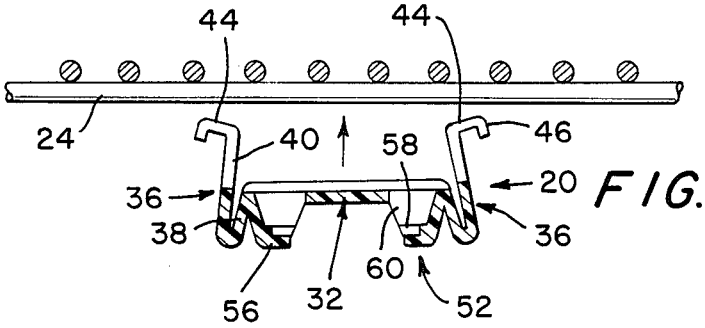
FIG. 3

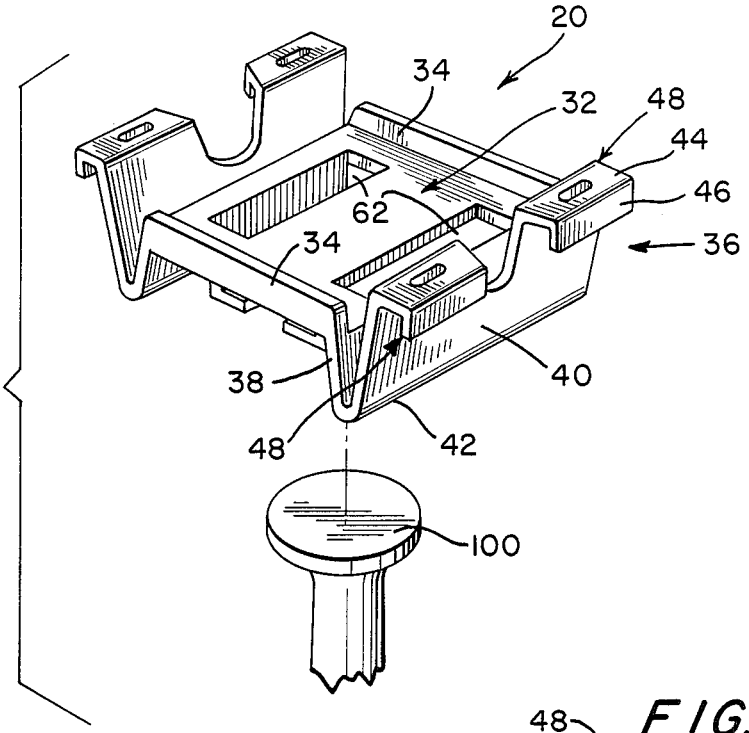
FIG. 4
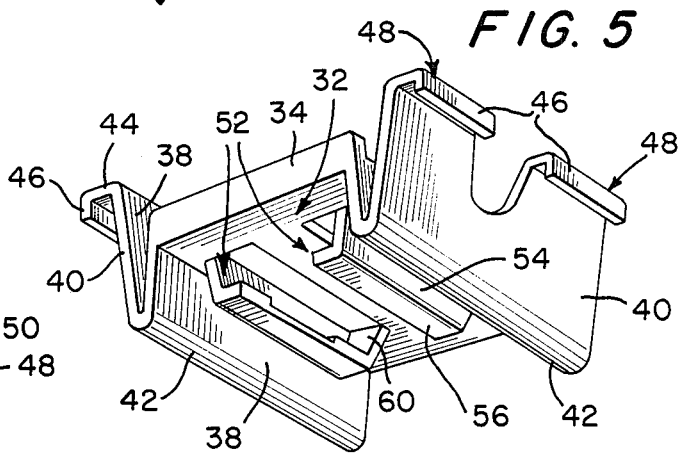
FIG. 5
FIG. 6
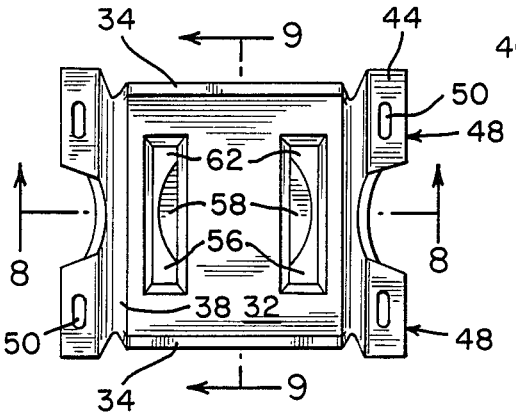
FIG. 8
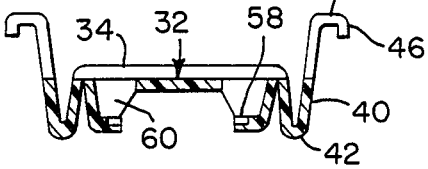
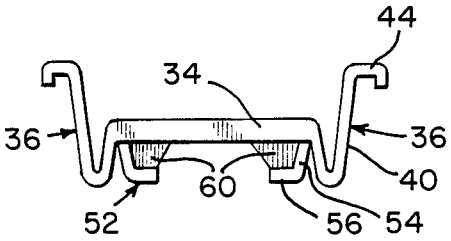
FIG. 7
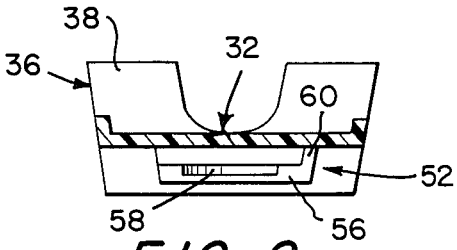
FIG. 9

STORAGE SYSTEM

BACKGROUND OF THE INVENTION

The necessarily compact interiors of refrigerators and like structures such as upright freezers and storage cabinets inherently give rise to problems with regard both to utilization of limited interior space to its maximum, and provision of convenient access to the stored items or goods. These problems are particularly acute in refrigerators which, under normal circumstances, will have goods introduced thereto and removed therefrom many times throughout the day. Further, in view of the conventional manner of stacking goods in and on relatively deep shelves, to take advantage of the full height between shelves, it is not unusual for the user of the refrigerator to have to remove or displace several items in order to obtain access to a particular item.

Various attempts have been made to facilitate the placement of goods within a refrigerator, in particular, for easy subsequent access thereto. For example, attention is directed to the following patents:

| | | |
|---|---|---|
| 1,687,149 | Shauer et al | October 9, 1928 |
| 2,070,055 | Levien | February 9, 1937 |
| 4,191,437 | Funke | March 4, 1980 |

Each of these patents proposes a refrigerator storage system wherein one or more rotatable trays are mounted on a refrigerator shelf whereby goods may be accommodated on the tray and, through a rotation thereof, selectively moved to the rear of the refrigerator for storage or to the front of the refrigerator for direct unencumbered access thereto. In each of these cases, the rotatable tray is merely a substitute for the shelf surface itself and, while providing for an enhanced access to the goods stored within the refrigerator, probably reduces the effective storage space and does not address the problem of full utilization of the vertical space between the shelves of a refrigerator.

While not in a refrigerator environment, it has long been known, as exemplified by the following patents, to suspend turntable-like units from overhead supports, generally shelves:

| | | |
|---|---|---|
| 2,010,962 | Reinsberg | August 13, 1935 |
| 2,082,088 | Wilson | June 1, 1937 |
| 2,431,837 | Spotts et al | December 2, 1947 |
| 2,525,538 | Gamin | October 10, 1950 |
| 2,754,166 | Ohm | July 10, 1956 |

The majority of these patents provide for a direct bolting or screwing of the turntable assembly to the overhead support, Reinsberg does show, in one embodiment, the reliance on spring biased hook members.

Suspension means in the nature of hooks will also be noted in the following patent:

1,684,558 Schwarz September 18, 1928

In Schwartz, the hooks engage the pipes of the refrigerating unit of a refrigerator and in turn support shoulder members for receiving a drain pan.

SUMMARY OF THE INVENTION

The present invention proposes a unique storage system which finds particular utility in both enhancing the storage space within a refrigerator and doing so in a manner which, notwithstanding an increase in the storage capacity of the refrigerator, actually improves access to the contents thereof.

The storage system of the invention is uniquely adapted for use in conjunction with the standard wire racks or shelves found within refrigerators, and will accommodate relatively substantial variations in rack size, wire spacing, and the like.

Basically, the storage system of the invention includes a shelf engaging mounting bracket and a bracket suspended tray assembly or lazy Susan. The bracket is particularly adapted to be manually manipulated for direct releasable locked engagement with the wires of a wire rack, relying solely on the structure of the bracket and without additional mechanical fasteners. The tray assembly slidably engages within the bracket and is retained therein for a support and rotatable presentation of goods.

The bracket itself includes an elongate planar base having mounting arms integral with the opposed edges thereof. Each mounting arm includes an inner depending portion or wall terminating, at the lower edge thereof, in a reversely turned elbow which integrally joins an upwardly directed and slightly outwardly flared outer portion or wall. The outer wall projects above the planar base and terminates in an outwardly directed flange having a depending outer retaining lip. Each of the outer walls may be bifurcated through the upper portion thereof, through the support flange and associated retaining lip to define, in effect, a pair of aligned spaced fingers. The inner and outer walls of each mounting arm are, in the planes thereof, rigid and non-extensible to provide for a positive suspension means for the bracket and tray to be in turn suspended from the bracket. However, each arm, and in particular the relatively thinner outer wall thereof, is, either by itself or at the adjoining portion of the elbow, laterally flexible for a selective movement of the arms toward each other for introduction upwardly through the wires of a conventional refrigerator rack.

In order to accommodate a tray assembly, the bracket includes a pair of depending opposed L-shaped supports integral with the base and extending longitudinally thereof. The L-shaped supports define a pair of spaced shoulders which receive and support an enlarged head on the handle of the tray assembly.

As desired, the mounting bracket will preferably be injection molded, as a single unit, of high impact plastic.

The tray assembly, the separate components of which will also preferably be molded of high density polyethylene, includes a base with an upwardly directed internally threaded axial socket and an annular bearing race. An annular bearing housing is positioned within the bearing race and in turn supports an overlying rotary platform for rotation relative to the base. The platform includes a central boss freely receiving the base socket therethrough. The rotary platform is retained on the base by a vertically elongate handle having a lower threaded shank end threaded within the internally threaded socket and an enlarged retaining collar overlying the boss whereby upward movement of the rotary platform relative to the base is precluded without limiting the free rotational movement of the platform. The upper end of the handle terminates in a disk-like or planar circular head which is in turn slidably received between the L-shaped supports of the mounting bracket into supported engagement on the opposed inwardly directed support shoulders of the bracket.

Other features of the storage system of the invention, as well as further advantages derived from the particulars of construction, will become apparent from the detailed description of the invention following hereinafter.

BRIEF DESCRIPTION OF THE DRAWINGS

FIG. 1 is a perspective view of the storage system of the present invention mounted on and depending from a wire rack or shelf of a refrigerator;

FIG. 2 is an enlarged cross-sectional detail taken substantially on a plane passing along line 2—2 in FIG. 1;

FIG. 3 is a cross-sectional detail of the bracket of FIG. 2 illustrating the manner of mounting;

FIG. 4 is a top perspective view of the bracket with the handle of the tray assembly exploded therefrom;

FIG. 5 is a bottom perspective view of the bracket;

FIG. 6 is a top plan view of the bracket;

FIG. 7 is a front elevational view of the bracket;

FIG. 8 is a tranverse cross-sectional view of the bracket taken substantially on a plane passing along line 8—8 in FIG. 6;

FIG. 9 is a longitudinal cross-sactional view of the bracket taken substantially on a plane passing along line 9—9 in FIG. 6;

DESCRIPTION OF THE PREFERRED EMBODIMENT

Figure 10:
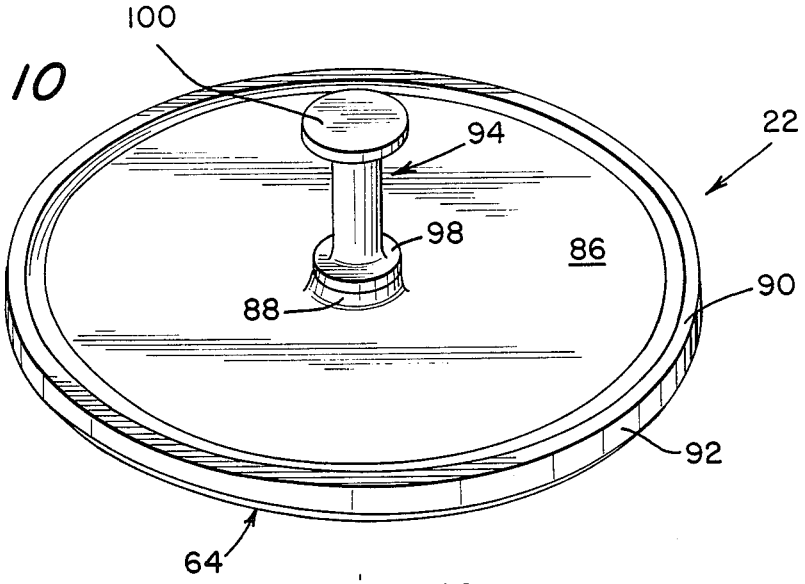
FIG. 10 is an exploded perspective view of the components of the tray assembly.

Referring now more specifically to the drawings, the support system of the present invention includes a mounting bracket 20 and a tray assembly 22 cooperatively engaged with the bracket 20 for suspension therefrom and rotation relative thereto.

The bracket 20, noting FIGS. 1 and 2 in particular, is specifically adapted to engage with and depend beneath a conventional refrigerator wire rack or shelf 24 of the type normally comprising multiple laterally spaced parallel elongate rigid wires 26 welded, at the opposed ends thereof, to transverse front and rear support rods 28. Such racks will also normally include one or more intermediate support rods 30 for a further stabilization of the wires 26. The bracket 20, preferably a single unit of injection molded high density polyethylene, incorporates both means for engaging and locking to the refrigerator shelf 24, and means for receiving and securing the tray assembly 22 without the addition of separate mechanical fasteners or the like.

More particularly, the bracket 20 includes an elongate planar base 32 terminating at the front and rear ends thereof in upstanding reinforcing or rigidifying ribs 34, each extending transversely across the full width of the base 32.

A pair of elongate mounting arms 36 are integrally formed along the opposed longitudinal edges of the base 32. These arms 36 are oppositely directed duplicates of each other. Each arm 36 includes an inner portion or wall 38 integral with and both depending and slightly flaring outward from the corresponding longitudinal edge of the base 32. An outer portion or wall 40 generally parallels each wall 38 in outwardly spaced relation thereto and is integrally joined to the lower edge of the corresponding inner wall 38 by a U-shaped bend or elbow portion 42. Each outer wall 40 flares slightly outward relative to the corresponding inner wall 38 and terminates in an upper outwardly directed support flange 44 in spaced relation above both the base 32 and the support ribs 34 thereon. Each outwardly directed flange in turn terminates in an integral depending retaining lip 46 along the outer edge thereof. As illustrated, each outer wall 40 can be centrally bifurcated through the lip, flange and upper edge thereof to define a pair of aligned finger portions 48, in which case, each finger portion 48 will include a corresponding portion of both the support flange 44 and the retaining lip 46. While not specifically illustrated, the bifurcated outer walls 40 will allow for a mounting of the bracket 20 in a position centrally underlying an intermediate support rod 30 of a refrigerator rack 24, thus providing an auxiliary means for limiting front to rear sliding movement of the bracket relative to the rack.

Noting the end elevational view of FIG. 7, as well as the cross-sectional views of FIGS. 2 and 3, it is contemplated that the outer walls 40 and the immediately adjoining section of the elbows or elbow portions 42, be relatively thinner than the inner walls 38 and capable of inward flexing upon the application of manual pressure thereto. This flexure, while illustrated in FIG. 3 as taking place primarily at the elbows 42, can also occur in the outer walls 40 as well as, to a substantially lesser degree, in the inner walls 38. Such flexure is made possible by the inherent nature of the material of the bracket 20 and is resiliently resisted with the memory characteristics of the material returning the mounting arms 36 to their original positions upon release of the pressure. The basically rigid nature of the inner and outer walls, and associated flanges 44 and retaining lips 46, provides for a stable mounted bracket, notwithstanding the ability to laterally resiliently flex for mounting and removal purposes in the manner suggested in FIG. 3.

With continued reference to FIG. 3, as well as FIG. 2, the bracket 20, through the laterally inward resilient flexing of the mounting arms 36, can be easily upwardly inserted through the wires 26 of a refrigerator rack 24 with the arms allowed to outwardly move to position the support flanges 46 in overlying relation to adjoining ones of the wires 26. Once seated on the corresponding wires 26, the wires will be confined between each outwardly biased outer wall 40 and the corresponding outwardly positioned retaining lip 46. Lateral shifting of the bracket relative to the wires of the rack 24 will be effectively precluded and longitudinal shifting will be resisted by the frictional gripping of the wires by the bracket. Similarly, through the simple expedient of engaging one end of the bracket 20 against an intermediate rack rod 30, longitudinal shifting of the bracket can be prevented in at least one direction. Positioning the bracket 20 in a manner whereby the rack rod 30 extends through the recess between the finger portions 48 of the mounting arms 46 will preclude shifting in both longitudinal directions.

It is also to be appreciated that the ability of the mounting arms 46 to inwardly flex provides for an accommodation of the bracket 20 to variations in wire spacing, wire size, and the like, thus providing in effect a universal bracket. Incidentally, in order to increase the versatility of the bracket, it will also be noted that apertures 50 have been provided through the support flanges 44, one aperture to each flange portion associated with the individual finger portions. Such apertures are particularly intended to accommodate mounting screws or like driven fasteners engaged upwardly therefrom and into fixed engagement with an overlying solid shelf, for example a wooden shelf within a kitchen cabinet.

In order to receive and accommodate the tray assembly 22, the mounting bracket 20 is provided with support means comprising a pair of laterally spaced, parallel, oppositely directed L-shaped supports 52 integral with and extending longitudinally along a major portion of the base 32 in depending relation thereto. The supports 52 include elongate side walls 54 depending from upper edges integral with the base 32 and having integral inwardly directed full length support shoulders 56 along the lower edges thereof. These shoulders 56 define an access slot therebetween and include, at approximately midpoint along the length thereof, a pair of positioning recesses 58 in the respective upper surfaces.

The opposed L-shaped supports 52 open forwardly or toward the front of the bracket for the accommodation of a corresponding portion of the tray assembly as shall be explained presently. Each of the associated supports 52 in turn includes an end wall 60 which defines a rear stop to the introduction of the tray assembly, and simultaneously functions as a means for rigidifying the support shoulders 56.

As will be noted from drawings, the base 32 includes a pair of holes or elongate slots 62 therein aligned with and over the L-shaped supports 52. Such holes or slots, particularly when a relatively low refrigerator shelf or rack is involved, will provide for a visual viewing of the insertion of the corresponding portion of the tray assembly and thereby aid in the proper location or orientation thereof.

Referring now to the cooperating tray assembly 22, and as will be particularly appreciated from FIGS. 1 and 2, the tray assembly 22 is specifically adapted for use in conjunction with the bracket 20. In accord therewith, the tray assembly releasably engages the mounting bracket 20 in a manner whereby the tray assembly 22 is supported solely from the overlying rack or shelf, providing a separate support platform in addition to the conventionally providing refrigerator shelves or racks.

Figure 11:
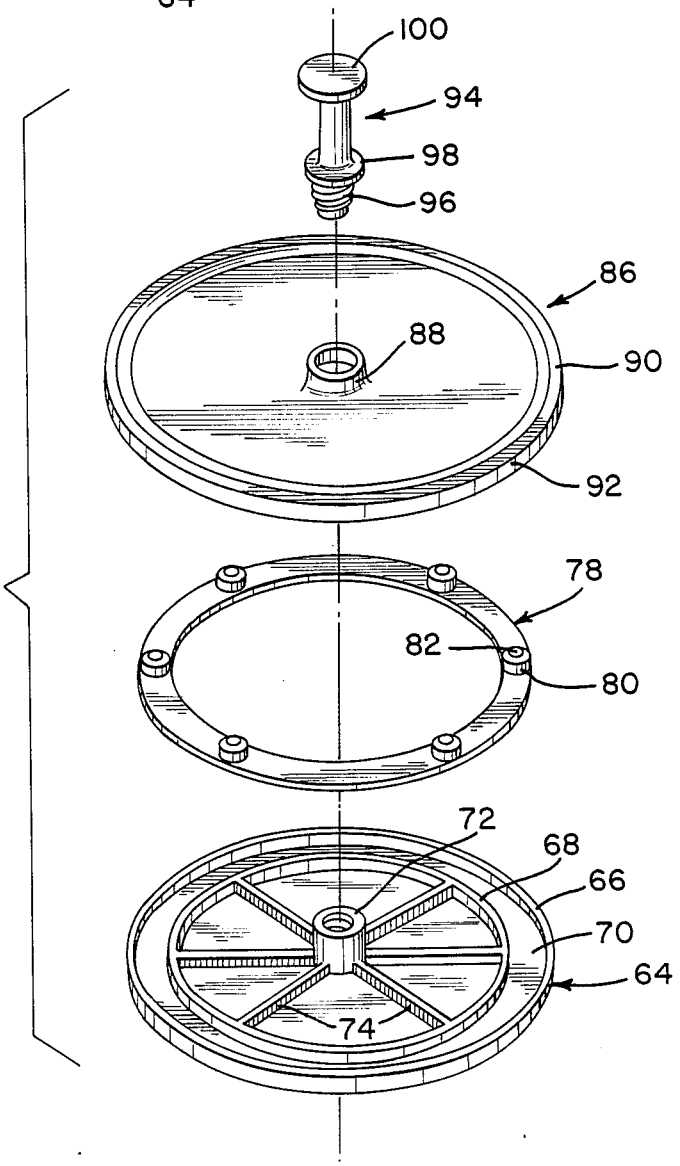
FIG. 11 is a top perspective view of the tray assembly.

Noting FIGS. 2 and 11 in particular, the tray assembly 22 comprises a circular generally planar base 64 having an outer integral upstanding peripheral flange 66 and an inner flange 68 concentric with the flange 66 and inwardly spaced therefrom a relatively minor distance to define an upwardly directed annular bearing race 70 therebetween. An integral upwardly projecting internally threaded socket 72 projects vertically upward from and at the central axis of the base 64 and, as noted in FIG. 2, may open axially through the bottom of the base 64. The annular wall of the socket 72 extends a substantial distance above the height of the annular flanges or ribs 66 and 68 and is rigidified, along with the planar portion of the base itself, by a plurality of integral ribs 74 extending radially between the wall of the socket 72 and the inner annular flange 68. These ribs 74 will normally be of a slightly lesser height than the height of the annular flange 68. The base 64 is completed by a short integral annular rib 76 extending from the bottom surface of the base in general alignment with the upwardly projecting race-defining flange 68.

An annular bearing housing 78 is received within the bearing race 70. This bearing housing 78 includes a plurality of retaining sockets 80 at peripherally spaced points thereabout, each socket 80 rotatably mounting a corresponding bearing 82 which is rollingly engaged with the race surface and simultaneously projects above the upper edges of the race-defining flanges 66 and 68.

The actual shelf-like support for the goods, containers, or the like 84 on the tray assembly 22 is a planar circular rotary platform 86. This platform 86 is positioned in parallel overlying relation to the base 64 and is supported for rotational movement relative to the base by the individual bearings 82 which engage the undersurface of the platform 86. An upwardly projecting annular boss 88 is integrally formed on the axis of the platform 86. This boss is of a size so as to be telescopically received about the upper portion of the base socket 72 for free rotation thereabout. The upper edge of the boss 88, as noted particularly in FIG. 2, is of a height so as to, when properly seated, terminate slightly below the upper edge of the socket 72. The platform 86 is completed by an integral peripheral upwardly formed retaining rib 90 terminating in a depending skirt 92 which surrounds the outer flange 66 of the base 64 in outwardly spaced relation thereto. As will be appreciated, the rib 90 functions as a means for retaining goods on the rotary platform 86, while the skirt provides a partial closure and protective means for the bearing assembly.

The base 64, bearing housing 78 and rotary platform 86 are maintained in operative relation to each other by the vertically elongate handle 94. The handle 94 includes an externally threaded lower shank end 96 which is threadedly received within the upwardly opening socket 72 of the base 64. An integral annular retaining collar 98 is formed on the handle shaft immediately above the threaded lower end portion 96 thereof. This collar, upon an engagement of the threaded lower end 96 within the socket 72, seats on the upper annular edge of the socket 72 and extends outwardly therefrom in overlying retaining relation to the axial boss 88 on the rotary platform 86. The collar 98, seated on the upper edge of the socket 72, will be positioned slightly above the upper edge of the annular boss 88 so as to preclude an upward withdrawal of the platform 86 without interference with the desired rotary movement thereof.

The upper end of the handle 94, or more particularly the shaft thereof, terminates in a circular or disc-like flat head 100 which constitutes the means of releasably engaging the tray assembly 22 with the mounting bracket 20.

More particularly, and noting FIG. 2, the shaft of the handle 94 is of a size which is easily received through the slot defined between the opposed inwardly directed support shoulders 56. The enlarged head 100, in turn, is of a substantially greater diameter than the width of the slot and, after introduction of the shaft through the open forward end defined by the opposed L-shaped supports 52, seats on the upper surfaces of the shoulders 56, and preferably within the opposed positioning recesses 58 configured to receive and closely conform to the head 100. The combination of the recesses 58 and the end walls 60 facilitate a proper positioning of the handle head 100 centrally within the mounting bracket 20 for a proper balanced support thereof.

It is contemplated that the length of the handle 94 be such as to provide for a usable height between the rotary platform 86 and the overlying refrigerator rack or shelf 24, while at the same time avoiding, to a substantial degree, any interference with the free use of an underlying shelf or rack. While the tray assembly can be used for the support and rotational positioning of any number of goods, it is particularly adapted for the support of sector shaped refrigerator containers of the general type suggested in phantom lines in FIG. 1.

The head and slot interengagement of the tray assembly with the mounting bracket provides a simplified means for both mounting and removing the tray assembly with the tray assembly, when removed, being equally adaptable for use as a lazy-Susan on a table, the annular depending rib 76 on the base 64 providing for a stable support. Similarly, the enlarged head 100, while specifically configured to engage within the bracket slot and seat on the opposed inwardly directed shoulders, also provides a means for manually lifting the tray assembly.

In addition, the mounting bracket 20, and hence the entire storage assembly, can be easily removed through merely a quick manual manipulation of the mounting bracket itself. As such, the storage assembly can be moved from one refrigerator shelf to another as desired, thus allowing for a substantial instantaneous rearrangement of the internal storage capacity of a refrigerator.

I claim:

1. In a storage system for engagement with and suspension from an overhead structure, a mounting bracket and a tray assembly supportable in depending relation by and from said bracket; said mounting bracket comprising a horizontal base having opposed side edges, a pair of oppositely directed mounting arms, one arm on each of said side edges, each arm terminating in spaced relation above said base in a laterally directed mounting flange, a pair of laterally inwardly directed support shoulders rigid with said base and in underlying relation thereto, said support shoulders defining a slot therebetween paralleling the side edges of said base; said tray assembly comprising a vertically elongate handle having an upper end and a lower end, a goods-receiving platform mounted on the lower end of said handle, the upper end of said handle including an enlarged head thereon of a greater transverse dimension than the width of the slot defined between the support shoulders of said mounting bracket, said handle, immediately below said head, being receivable within said slot for supporting engagement of said head on said support shoulders.

2. The storage system of claim 1 wherein the mounting flanges of said mounting arms are outwardly directed relative to the corresponding side edges of the base, said mounting arms being laterally resiliently flexible for a selective manual laterally inward flexing of said arms and the mounting flanges thereon to an inwardly flexed position, said mounting arms being resiliently biased outward relative to said inwardly flexed position.

3. The storage system of claim 2 wherein each of said mounting arms includes an inner wall depending from the corresponding side edge of said base, an outer wall in outwardly spaced generally parallel relation to said inner wall, and joinder means interconnecting the respective lower edges of each inner wall and the corresponding outer wall, each outer wall extending upwardly into spaced relation above said base and terminating in one of said mounting flanges.

4. The storage system of claim 3 wherein each outer wall is relatively thinner than the corresponding inner wall and inherently resiliently laterally flexible.

5. The storage system of claim 4 wherein each said outer wall is transversely bifurcated, defining a pair of coplanar finger portions, each incorporating an upper portion of the corresponding arm and a portion of the corresponding laterally directed mounting flange.

6. The support system of claim 5 wherein said mounting bracket is an integrally molded one-piece unit.

7. The support system of claim 3 wherein each said outer wall is transversely bifurcated, defining a pair of coplanar finger portions, each incorporating an upper portion of the corresponding arm and a portion of the corresponding laterally directed mounting flange.

8. The support system of claim 3 wherein each said mounting flange terminates in an outer depending retaining lip.

9. The support system of claim 3 including a positioning recess defined in each shoulder and being configured for reception of the head of the tray assembly handle therein.

10. The support system of claim 9 including an opposed pair of L-shaped supports, each support shoulder comprising a horizontal component of one of the L-shaped supports, each support including a side wall directly engaged between the corresponding shoulder and the overlying base, and an end wall engaged between each shoulder and the overlying base, perpendicular to the corresponding side wall and defining an inward terminus to the shoulder.

11. The support system of claim 9 wherein said tray assembly comprises a horizontal tray base, an axially upwardly opening socket on said tray base, said goods-receiving platform overlying said tray base, bearing means supporting said platform on said tray base for rotation of said platform relative to said tray base, a central opening defined through said platform in alignment with said socket, the lower end of said handle being freely received through the platform opening and into fixed engagement within said socket for the direct support of said tray base from said handle.

12. The storage system of claim 11 wherein said socket is defined by an upstanding annular wall projecting through and above said platform opening, an enlarged collar on said handle above the lower end thereof, said collar engaging the upper end of said socket wall and extending laterally outward thereof in spaced relation above said platform for a retention of said platform for rotation relative to said tray base.

13. The storage system of claim 12 including radial reinforcing ribs on said tray base between said socket wall and said bearing race.

14. The support system of claim 3 including mounting apertures defined through said mounting flanges for the reception of driven fasteners.

15. In a storage system for engagement with and suspension from an overhead structure, a mounting bracket for mounting and support of a tray assembly in depending relation thereto, said mounting bracket comprising a horizontal base having opposed side edges, a pair of oppositely directed mounting arms, one arm on each of said side edges, each arm terminating in spaced relation above said base in a laterally, outwardly directed mounting flange for engagement with overhead structure, said mounting arms being laterally resiliently flexible for a selective manual laterally inward flexing of said arms and the mounting flanges thereon to an inwardly flexed position, said mounting arms being resiliently biased outward relative to said inwardly flexed position, each of said mounting arms including an inner wall depending from the corresponding side edge of said base and terminating in a lower edge below said base, an outer wall in outwardly spaced generally parallel relation to said inner wall, said outer wall including a lower edge parallel to and adjacent the lower edge of the inner wall, and joinder means interconnecting the respective lower edges of each inner wall and the corresponding outer wall below said base, each outer wall extending upwardly from the lower edge thereof below the base to spaced relation above said base and terminating in one of said mounting flanges, and support means rigid with said base and in underlying relation thereto for releasable supporting engagement with the tray assembly.

16. The storage system of claim 15 wherein each outer wall is relatively thinner than the corresponding inner wall and inherently resiliently laterally flexible relative thereto.

17. The storage system of claim 16 wherein each said outer wall is transversely bifurcated, defining a pair of coplanar finger portions, each incorporating an upper portion of the corresponding arm and a portion of the corresponding laterally directed mounting flange.

18. The support system of claim 17 wherein said mounting bracket is an integrally molded one-piece unit.

19. The support system of claim 15 wherein each said outer wall is transversely bifurcated, defining a pair of coplanar finger portions, each incorporating an upper portion of the corresponding arm and a portion of the corresponding laterally directed mounting flange.

20. The support system of claim 15 wherein each said mounting flange terminates in an outer depending retaining lip.

21. The support system of claim 15 wherein said support means includes an opposed pair of L-shaped supports, each support comprising a horizontal shoulder component and a side wall directly engaged between the corresponding shoulder component and the overlying base, and an end wall engaged between each shoulder component and the overlying base, perpendicular to the corresponding side wall and defining an inward terminus to the shoulder component.

22. The support system of claim 21 wherein each shoulder component includes an upper surface, and a positioning recess defined in each shoulder component within and below the upper surface thereof.

23. The support system of claim 15 including mounting apertures defined through said mounting flanges for the reception of driven fasteners.

24. In a storage system for engagement with and suspension from an overhead structure, a mounting bracket and a tray assembly supportable in depending relation by and from siad brackert; said mounting bracket comprising a horizontal base having opposed side edges, a pair of oppositely directed mounting arms, one arm on each of said side edges, each arm terminating in spaced relation above said base in a mounting flange for engagement with overhead structure, said mounting arms being laterally resiliently flexible for a selective manual laterally inward flexing of said arms and the mounting flanges thereon to an inwardly flexed position, said mounting arms being resiliently biased outward relative to said inwardly flexed position, support shoulders rigid with said base and in underlying relation thereto, said support shoulders defining a slot therebetween; said tray assembly comprising a vertically elongate handle having an upper end and a lower end, a goods-receiving platform mounted on the lower end of said handle, the upper end of said handle including an enlarged head thereon of a greater transverse dimension than the width of the slot defined between the support shoulders of said mounting bracket, said handle, immediately below said head, being receivable within said slot for supporting engagement of said head on said support shoulders.

* * * * *